US005628108A

United States Patent [19]

Ingwersen et al.

[11] Patent Number: 5,628,108

[45] Date of Patent: May 13, 1997

[54] WIRE TRANSFER AND CUTTING ASSEMBLY SUITABLE FOR USE WITH MULTIPLE WIRE TERMINATION APPARATUS

[75] Inventors: Peter Ingwersen, Gilberts; Lawrence M. Kurek, Elgin; Thomas P. Pellegrino, Lisle, all of Ill.

[73] Assignee: Molex Incorporated, Lisle, Ill.

[21] Appl. No.: 324,817

[22] Filed: Oct. 17, 1994

[51] Int. Cl.[6] ..... H01R 43/01; H01R 43/28

[52] U.S. Cl. ..... 29/749; 29/33 M; 29/564.4; 29/564.6; 29/759; 140/1; 198/803.9; 414/751

[58] Field of Search ..... 29/33 M, 747, 29/748, 749, 759, 564.4, 564.6; 83/151; 140/1; 198/803.9; 414/751

[56] References Cited

U.S. PATENT DOCUMENTS

| | | | |
|---|---|---|---|
| 3,029,494 | 4/1962 | Andren | 29/33 M X |
| 3,653,412 | 4/1972 | Gudmestad | 140/1 |
| 4,110,880 | 9/1978 | Peppler et al. | 29/564.6 X |
| 4,136,440 | 1/1979 | Brandewie et al. | 29/749 X |
| 4,164,808 | 8/1979 | Gudmestad et al. | 414/751 X |
| 4,166,315 | 9/1979 | Gudmestad et al. | 29/564.4 |
| 4,367,583 | 1/1983 | Baccei | 29/747 X |
| 4,372,041 | 2/1983 | Windelman | 198/803.9 X |
| 4,380,117 | 4/1983 | Brandewie | 29/749 X |
| 4,428,114 | 1/1984 | Teagno | 29/564.6 X |
| 4,493,147 | 1/1985 | Bakermans | 29/748 X |

FOREIGN PATENT DOCUMENTS

| | | | |
|---|---|---|---|
| 3821432 | 1/1989 | Germany | 29/748 |
| 2108017 | 5/1983 | United Kingdom | 29/749 |
| 9115044 | 10/1991 | WIPO | 29/747 |

*Primary Examiner*—Peter Vo
*Attorney, Agent, or Firm*—Charles S. Cohen

[57] ABSTRACT

A wire transferring assembly for a wire harness assembly machine has two adjoining termination stations. First connector elements are advanced in a reciprocating nest from a supply of connector elements into contact with wires extending from a positioning head and terminated thereto. After termination, to the wires, the connector elements are drawn away in the nest from the wire feed source and the wires are cut at their ends opposite the first connector elements. The cut wires are clamped onto a moveable clamping head and maintained in a preselected order while they are transferred to a second termination location, where a row of second connector elements are advanced into contact with the wire ends and terminated thereto.

17 Claims, 8 Drawing Sheets

WIRE TRANSFER AND CUTTING ASSEMBLY SUITABLE FOR USE WITH MULTIPLE WIRE TERMINATION APPARATUS

BACKGROUND OF THE INVENTION

The present invention relates generally to wire harness assembly machines, and more particularly, relates to a wire transfer and cutting assembly suitable for use with harness assembly machines which terminate multiple harness wires to opposing connector elements at two different termination positions within the assembly machine.

Wire harnesses and cable assemblies are used in numerous electronic products, such as consumer electronic products like televisions, computers and stereo components. Wire harnesses are also used in many larger applications, such as automobiles and may be further used in many industrial control applications. Wire harness manufacturers are constantly searching out ways to reduce the cost of manufacture of the harnesses, as well as to reliably increase the production thereof. Wire harnesses may take a variety of forms, the most common form having a series of parallel wires extending between and terminated to two electrical connector elements.

The connector elements of wire harnesses are typically formed from an insulative material with one or more wire-receiving cavities formed therein. The cavities contain electrical terminals corresponding in number to the wire-receiving cavities. In one type of connector element, the terminals pierce the electrical insulation surrounding the conductor portions of the wires to establish an electrical connection therebetween. The terminals may be located in a first connector element component while the wire-receiving cavities may be located in a second connector element component which engages the first connector element to form a connector element terminated to one end of a series of wires. A second connector element is likewise terminated to the opposite ends of the wires.

There are many different types of fully automated machines for terminating harnesses. One type manufactured by the assignee of the present invention has one termination station at which both ends of a harness are terminated. In operation, a first connector element is terminated to first free ends of a plurality of wires. The terminated connector element is moved along the axis of the wires and the wire fed to a desired length. The wire is then clamped and cut to create second free ends of the wires which are terminated to a second connector element at the termination station. This process is sequentially repeated for each wire harness.

In order to accelerate production, it is desirable that while the second connector elements are terminated to the second free ends, the first connector elements of a subsequent wire harness are terminated to its associated first wire free ends. In order to effect this simultaneous and offset termination, it becomes desirable to have two termination stations. This arrangement poses a problem of managing unterminated wires, especially in the termination of either wire harnesses having large numbers of wires or in the simultaneous termination of multiple harnesses having many wires in total. It is desirable to maintain the order of multiple harness wires as they are transferred between termination locations in a harness-making machine such that the wires are terminated to the second connector elements in their desired order. It is also desirable to protect the second set of wire free ends as they are transferred from the first termination station to a second termination station to ensure that the free ends are readily terminatable at the second termination station. Therefore, a need exists for a transfer mechanism utilizable in the termination of multiple wires which protects the unterminated wire ends as they are transferred from one termination location to another termination location.

Accordingly, it is an object of the present invention to provide an improved assembly which transfers multiple wires of wire harnesses during the fabrication thereof while maintaining the position of the wires in place within the harnesses.

It is another object of the present invention to provide a method for transferring wire harnesses during their fabrication in which connector elements are terminated to opposite ends of multiple harness wires along a common line of action, wherein the harness wires are gripped after being terminated to first connector elements at a first termination station at one end thereof of the wires, transferred from the first termination location to a second termination location, maintaining the order of the wires during the transfer movement, protecting the wires during the transfer movement and gripping the wires while the opposite ends thereof are terminated to second connector elements at the second termination location.

It is yet another object of the present invention to provide a wire positioning and transferring assembly for use in a wire harness-making apparatus wherein first and second work elements are applied to opposing ends of a series of wires, wherein the positioning assembly retains the harness wires in a termination position within a clamping head as the positioning assembly moves between first and second work locations, the clamping head including means for holding the wires in alignment with a series of second work elements, the clamping head having a collapsible wire guide means mounted thereon which protects the ends of the wires during transfer between the first and second work locations and which guide the wire ends as work elements are applied thereto.

It is yet a further object of the present invention to provide a transfer mechanism for transferring a plurality of wires between two wire termination locations in which first and second connector elements are applied to first and second opposite ends of the wires, the transfer mechanism, the shuttle mechanism including two opposing wire griping members, each of the two opposing wire-gripping members being reciprocatable along two different axes which lie along a common line of action between the two termination locations, each wire-gripping member each having a wire-engaging surface thereon defining a wire pathway therebetween, the transfer mechanism further including a collapsible wire locator which maintains loose ends of the harness wires in a preselected order as they are transferred between first and second termination locations, the wire locator maintaining the wire loose ends in alignment with a second termination means, such that when a series of wire connector elements are moved toward the transfer mechanism the wire locator is displaced toward the transfer mechanism to expose the wire loose ends for termination.

SUMMARY OF THE INVENTION

In accordance with these and other objects, the present invention provides a new and improved wire transfer assembly for use in a wire harness-making machine in which the wire transfer assembly receives a feed of wires therethrough and grips the wires to maintain them in a preselected position as the transfer assembly moves the wires to a second work location without altering the order of the wires and selectively exposes the wires into position for termination into second connector elements.

In one principal aspect, the present invention includes a clamping head mounted for reciprocating movement along a wire transfer path extending between the two work locations of the harness-making machine at which termination of opposing first and second connector elements occurs to corresponding opposing free ends of the harness wires. The clamping head includes a pair of opposing wire engagement surfaces which reciprocate as a unit along the wire transfer path. These two opposing wire engagement surfaces define a passage through which the harness wires pass as they are fed past their first termination location prior to the cutting thereof. The clamping head further has means defining an extension of this narrow passage which maintains the wires in their original order and protects them during the transfer of the wires to the second work station.

In another principal aspect of the present invention and in accordance with the preferred embodiment, the clamping head includes a collapsible wire locator mechanism which extends from the clamping head toward the second termination station of the harness-making machine. This mechanism includes a locator bar and a support bar, the locator bar having a plurality of grooves formed which are aligned with the wires held by the transfer assembly clamping head and which further correspond to a plurality of wire-receiving openings formed in an array of second connector elements. The support bar provides a support surface for the wires held in the transfer assembly and defines the bottom surfaces of the locator bar grooves. Both the locator and support bars are spring-loaded within the clamping head and extend outwardly over the free ends held by the clamping head. The wires extend within the locator bar slots and supported in the slots by the support bar to thereby protect the wire free ends during their transfer between the first and second work locations of the harness-making machine. The locator and support bars are disposed generally perpendicular to the axes of the wires to support and guide the wires into engagement with connector elements for termination.

In still another feature of the present invention, the locator and support bars are spring biased in their mounting upon the clamping head so that they collapse upon the clamping head when the support bar is contacted by a connector element carrier.

These and other objects, features and advantages of the present invention will be apparent through a reading of the following detailed description, taken in conjunction with accompanying drawings, wherein like reference numerals refer to like parts.

BRIEF DESCRIPTION OF THE DRAWINGS

In the course of the description, reference will be made to the attached drawings in which:

FIGS. 7A–H are plan views of a wire harness assembly machine in which the present invention is especially useful, illustrating the sequence of operation for termination of a wire harness in which FIG. 7A illustrates the step of loading an array first connector elements into the first connector termination carrier;

FIG. 7B is a view illustrating the step of shuttling the array of first connector elements into place within the first work station where wires are driven into the first connector elements and terminated thereto;

FIG. 7C is a view illustrating the step of urging the shuttled array of connectors into the first work station into contact with a series of harness wires and terminating the wires to the an array of first connector elements;

FIG. 7D is a view illustrating the step of shuttling the array of terminated first connector elements away from the first work station in order to define the length of the wires in the wire harness;

FIG. 7E is a view illustrating the step of clamping the harness wires in place within the transfer assembly and cutting the wires to define a set of wire free ends;

FIG. 7F is a view illustrating the step of shuttling a successive array of first connector elements to the first work station while transporting an array of second connector elements to the second work station;

FIG. 7G is a view illustrating the step of bringing the array of second connector elements into contact with the transfer assembly and terminating the second connector elements to the wire free ends while terminating the first connector elements to a successive set of harness wires;

FIG. 7H is a view illustrating the step of drawing the termination carrier containing the terminated successive array of connector elements back to the connector element supply track;

DETAILED DESCRIPTION OF THE PREFERRED EMBODIMENTS

Figure 1:
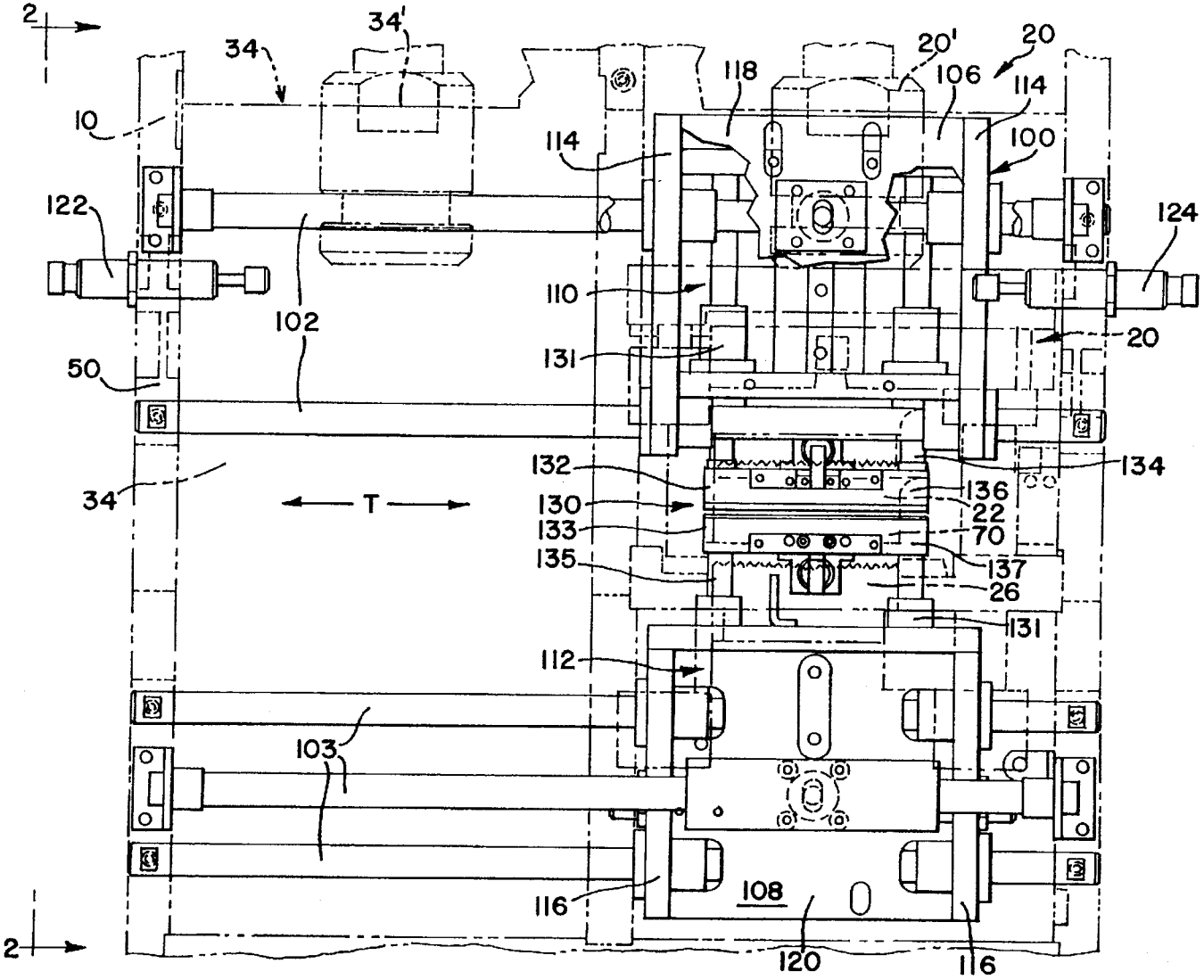
FIG. 1 is a front elevational view of a wire transfer assembly constructed in accordance with the principles of the present invention as mounted upon the frame of a wire harness-making machine in front of a first termination station of the machine.

Referring to FIG. 1, a wire transfer assembly, generally indicated at 100, is illustrated in place upon a wire harness-making machine 10 which makes wire harnesses of the type in which a series of wires extend between two opposing connector elements or sets of connector elements. The operation of the harness-making machine 10 shall be described first in order to define the general operational environment in which the transfer assembly 100 operates.

FIGS. 7A–H illustrate the wire harness-making machine 10 and the sequence for producing wire harnesses. Generally, such machine first terminates a first connector element to first ends of a set of wires, establishes the length of the wires for the harness and cuts the wires to provide wires having a preselected length. After the harness wires are cut, the wires are transferred to another location of the harness-making machine in which a second connector element is applied to the free ends of the wires and terminated thereto while a subsequent first connector element is terminated to the next set of wires. This process is repeated until a predetermined number of harnesses are manufactured.

The connector elements 12 which are terminated to opposing wire ends in the machine 10 shown typically have a two-piece or two-component construction. The two components may include interengaging base and head components 60 and 62 (FIGS. 5 and 6), in which one of the two components, typically the base component 60, has a plurality of wire-receiving openings 64 which lead to an internal cavity 66. The base component acts as the female portion of the two connector elements because its internal cavity accommodates not only the free ends of the harness wires inserted into the wire-receiving openings, but also a projecting portion of the head component.

The head component 62 typically contains one or more electrical terminals extending along its projecting portion which are aligned with the wires accommodated in the base component internal cavity. The two connector components are partially engaged with each other and are loaded into the harness making machine 10, preferably in the form of supply belts of interconnected connector elements, wherein wires are introduced thereinto and the base and head components are pressed together to interlock them together so that the terminals of the head component engage the wires held in the base component.

It should be noted that the harness-making machine 10 is of the type that can simultaneously terminate a predetermined number of wires to an identical number of terminals. For example, such a machine may be capable of terminating one connector having sixteen terminals, two connectors having eight terminals, four connectors having four terminals, etc. without affecting the present invention.

Returning to FIG. 7A, a preselected number of connector elements 12 are advanced along a first connector element supply track 16 until a preselected number of them constituting an array 14, enter a connector element termination carrier 18 (FIG. 7A). The carrier 18 is aligned with and disposed across from a first work station 20, which includes a wire locator 22, a first termination assembly 24 and a cutting mechanism 26. The carrier 18 is slidably mounted on a rail 28 and driven in a reciprocating movement by a servomotor 30.

After the carrier 18 has received the array 14 of first connector elements 12, the carrier 18 is shuttled (FIG. 7B) to the first work station 20, where a plurality of harness wires 32 are driven by individual wire feed servo motors 33 through a wire guide mechanism 22, preferably having a plurality of longitudinal channels (not shown) which guide the harness wires 32 in a preselected order to the first work station 20 and to the array of first connector elements held in the carriage 18. Throughout the course of this detailed description, the term "first" shall refer to the connector elements and wires which are provided at the first work station 20, which are advanced along the transfer track 16 shown at the right of the harness-making machine 10 illustrated in FIGS. 7A–G and the wire free ends which are terminated to these connector elements.

Figure 7B:
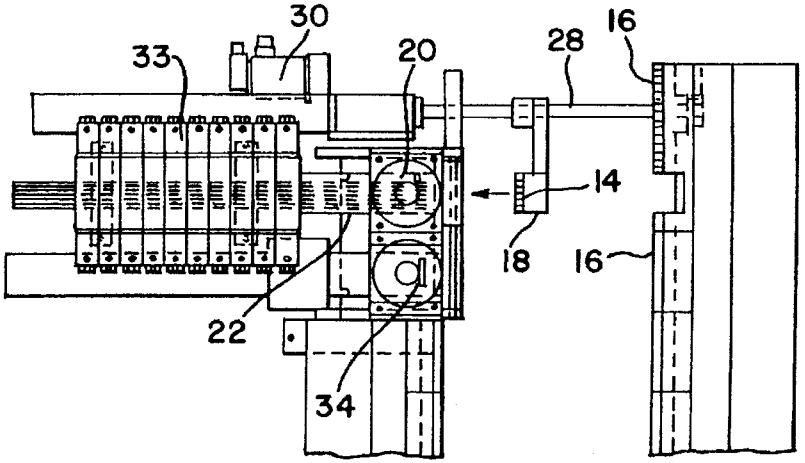
Figure 7D:
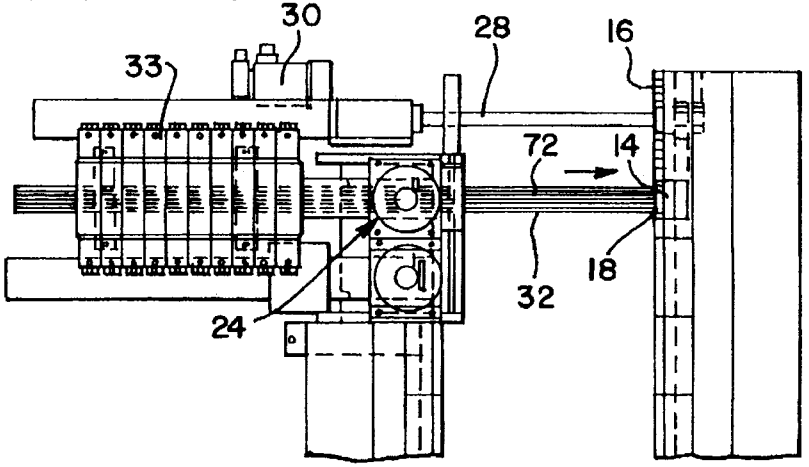
Figure 7A:
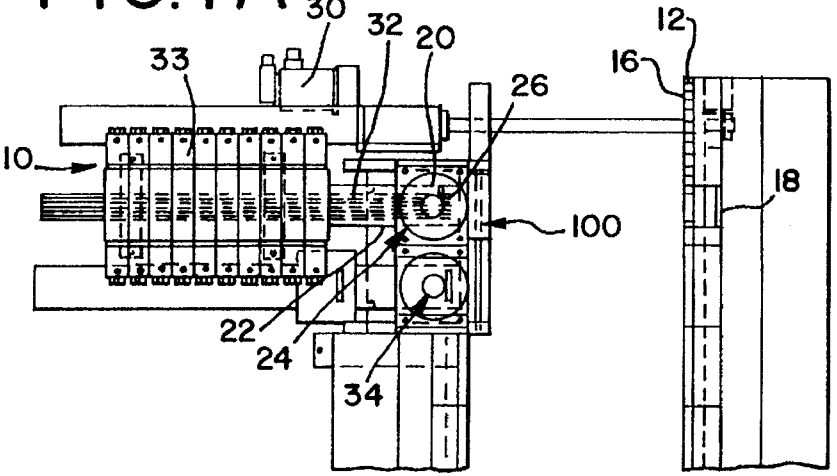
Figure 7C:
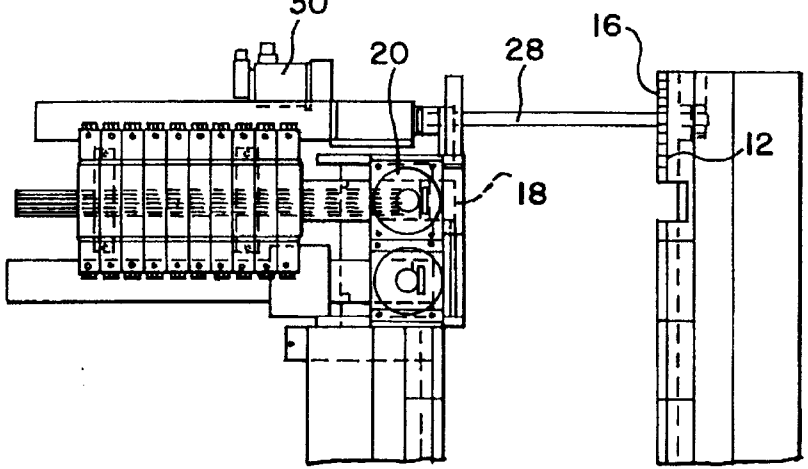
Figure 7F:
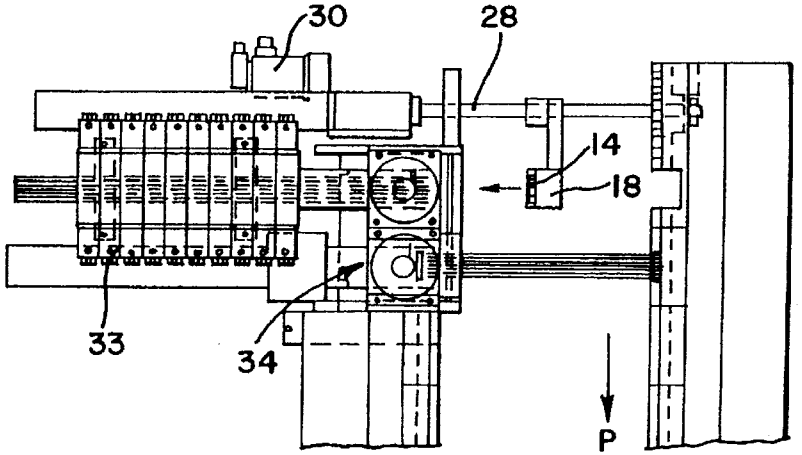
Figure 7H:
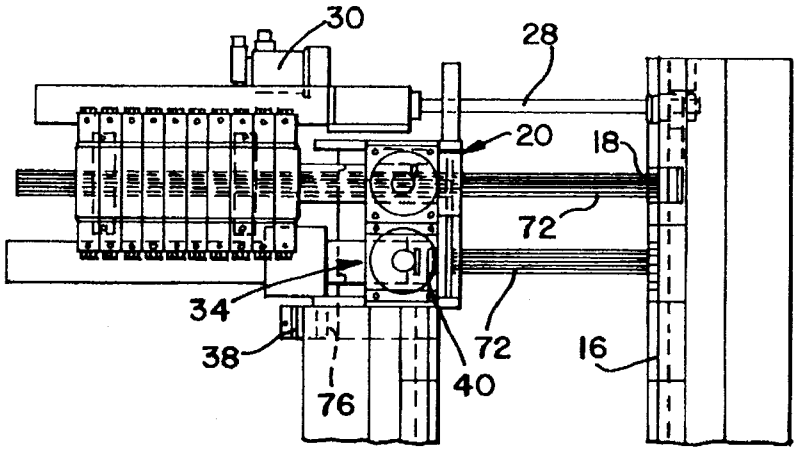

As the carriage 18 holding the first connector elements engages the first work station 20, the free ends of the harness wires advance into wire-receiving openings of the first connector element array 14. After the harness wire free ends enter the connector element openings, the wires are terminated by pressing the head and base components together until they interlock together. (FIG. 7C.) The terminated first connector element array 14 is then shuttled back to the connector element transfer track 16 and the harness wires 32 are fed from their respective feed supplies past the transfer assembly 100 to thereby define the final length of the wires in the harness(es) (FIG. 7D).

Figure 7E:
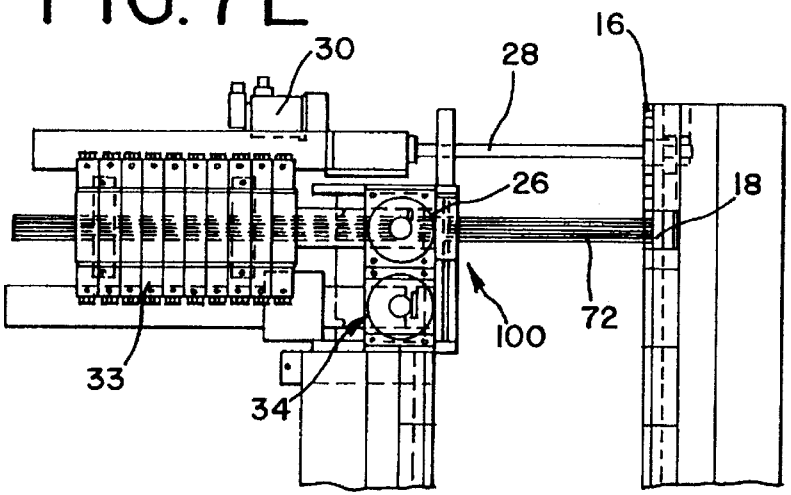
Figure 7G:
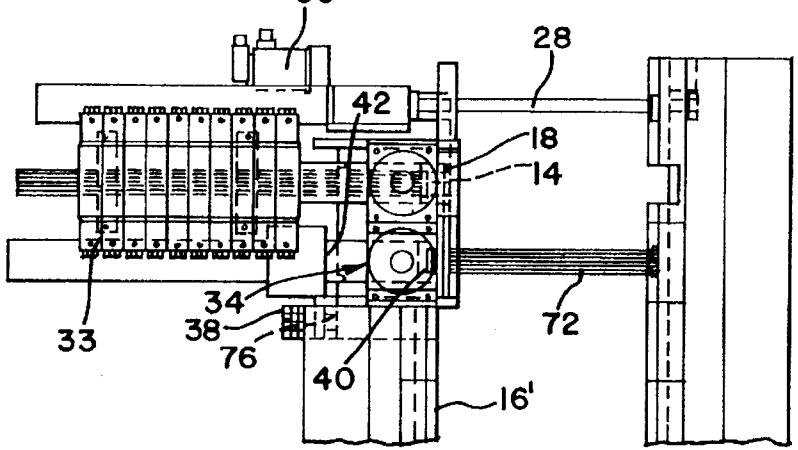
Figure 8:
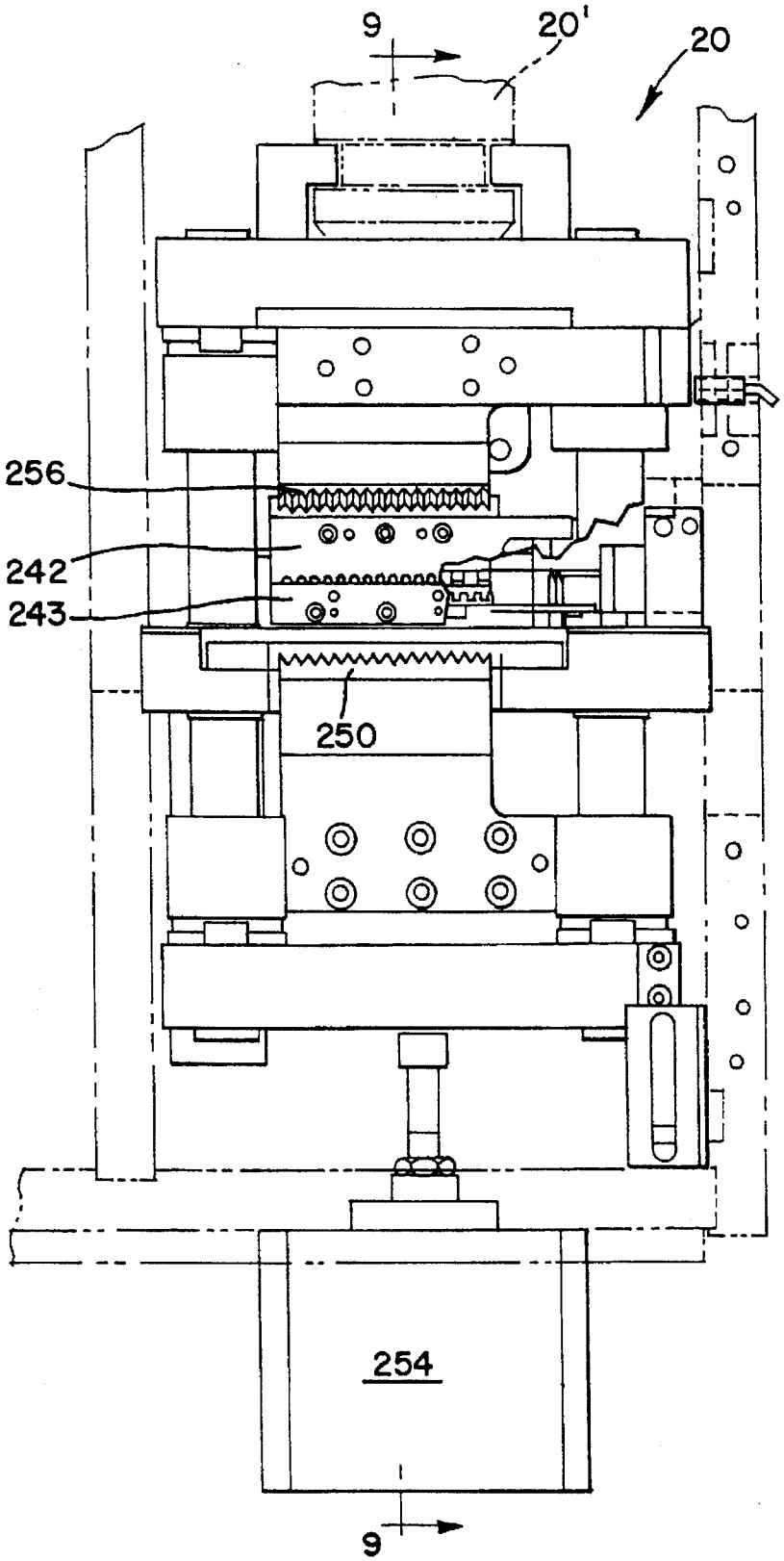
FIG. 8 is a front elevational view of the first termination station of the wire harness assembly machine of FIGS. 7A–7H.

As shown generally in FIG. 7E, the wires of the harness are then clamped within the transfer assembly 100 and the wires are cut by the cutting mechanism 26 to define a series of wire second free ends held in place by the transfer assembly 100 in the same prearranged order as they entered the transfer assembly 100 from the wire guide mechanism 22 of the first work station 20. The transfer assembly 100 subsequently laterally transfers the clamped wires from the first work station 22 to a second work station 34 (FIG. 7F) and maintains the alignment of the wire second free ends in the original order and prepared to receive a plurality of second connector elements thereupon. A successive first connector array 14 is then loaded into the connector element carriage 18 and shuttled from the supply track 16 to the first work station 20 for termination as described above.

A second connector element array 38 is thereupon loaded into a second carriage 42 which is aligned with the second work station 34 and subsequently brought into contact with the transfer assembly 100. This contact exposes the second free ends of the wires held by the transfer assembly 100 and the wire-receiving openings of the second connector element array receive the free ends. The second connector element components are then pressed together to interlock them and terminate the wire free ends to the terminals therein. Once the second connector elements are terminated to the harness wires, the completed wire harnesses are then transported along a production path P (FIG. 7F) with first connector elements sliding along the first supply track 16 and the opposing, second connector elements sliding along the second supply track 16'.

In operation, the first and second work stations are intended to operate simultaneously to terminate the first connector of one harness and the second connector of a prior harness. Accordingly, the termination sequence shown in FIGS. 7A–7E normally occurs with additional harnesses positioned laterally downstream of the first harness. For example, a comparison between FIGS. 7B and 7F reveals the operations to be identical except that a second or prior harness is located downstream in FIG. 7F. As such, a connector of both harnesses will be terminated during the step shown in FIG. 7G— the first connector of the second harness 72' and the second connector of the first harness 72.

Returning to FIG. 1, the transfer assembly 100 is mounted upon selected frame components 50 of the harness-making machine 10, in front of a first work station 20, shown in phantom. The transfer frame 50 includes a plurality of guide rails 102, 103 which extend between the frame components 50 and provide a path T along which the assembly 100 reciprocates in its operation between the first work station 20 where the array 14 of first connector elements are terminated (FIG. 7G) and a second work station 34 where an array of second connector elements is terminated to the opposite ends of the harness wires 32. The press rams 20' and 34' of the first and second work stations 20 and 34, respectively, are shown in phantom.

The transfer assembly 100 is shown as having two components: an upper component 106 and a lower component 108, each of which is mounted upon the guide rails 102, 103. The two transfer components 106,108 each include a respective carriage, or chassis, 110, 112 formed between opposing structural plates 114,116 interconnected by transverse stiffener plates 118, 120. These two transfer carriages 106, 108 are preferably pneumatically-operated in their movement between the first and second work stations 20, 34 utilizing a suitable arrangement of air supply hoses 55 (FIGS. 3A, 3B), pistons and the like. Shock absorbers 122, 124 are mounted on either the machine frame or the carriages to provide a cushioning, or regulated stopping force to the upper and lower transfer assembly carriages 110, 112. These shock absorbers 122, 124 engage stop members formed either by a surface of the structural plates 114 or by a separate member applied to the frame 50 of the harness-making machine 10. The shock absorbers or their associated stops may be interconnected by conventional means to a control system which controls the transfer assembly 100 in order to monitor the position of the transfer assembly components during operation.

Figure 2:
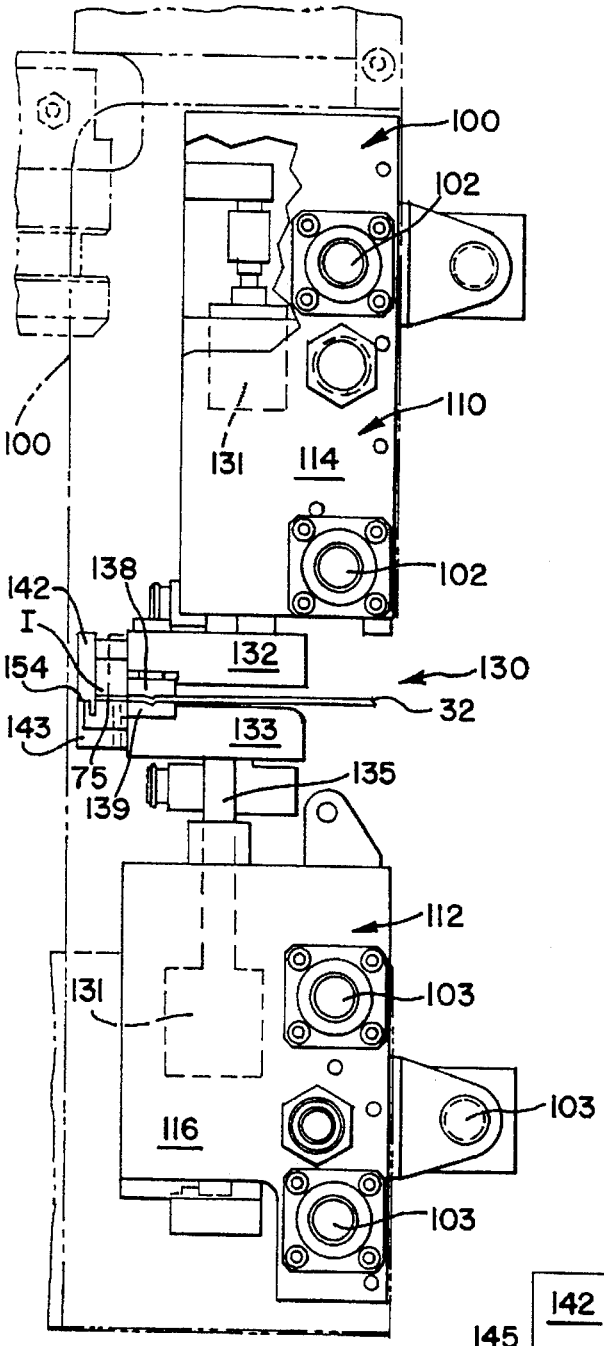
FIG. 2 is a side elevational view of the wire transfer assembly of FIG. 1 taken along lines 2—2 thereof.
Figure 3A:
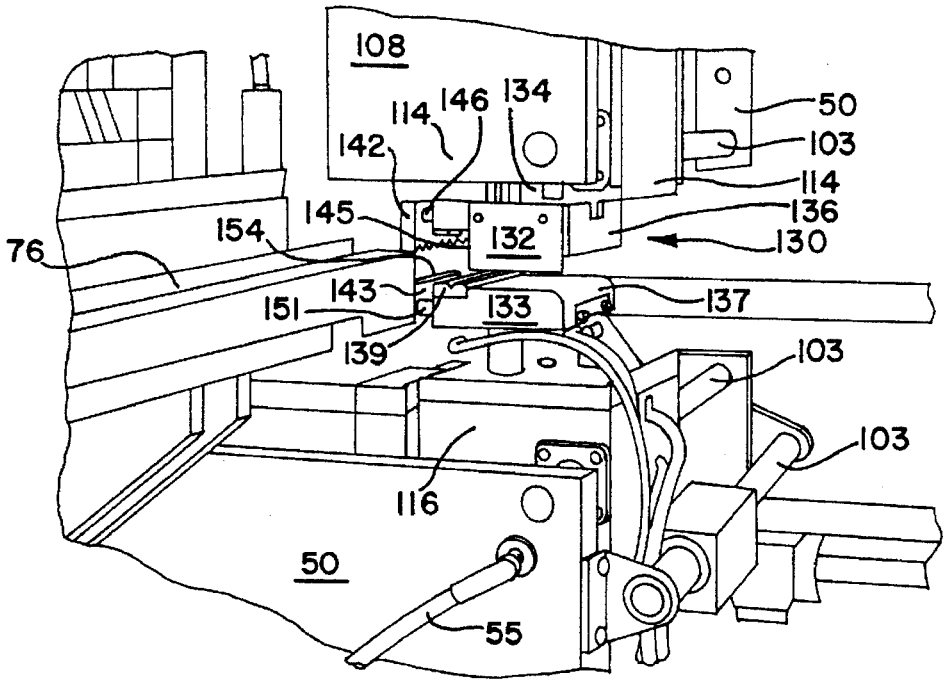
FIG. 3A is a perspective view taken from the side of the wire harness-making machine illustrating the clamping head portion of the transfer assembly.
Figure 3B:
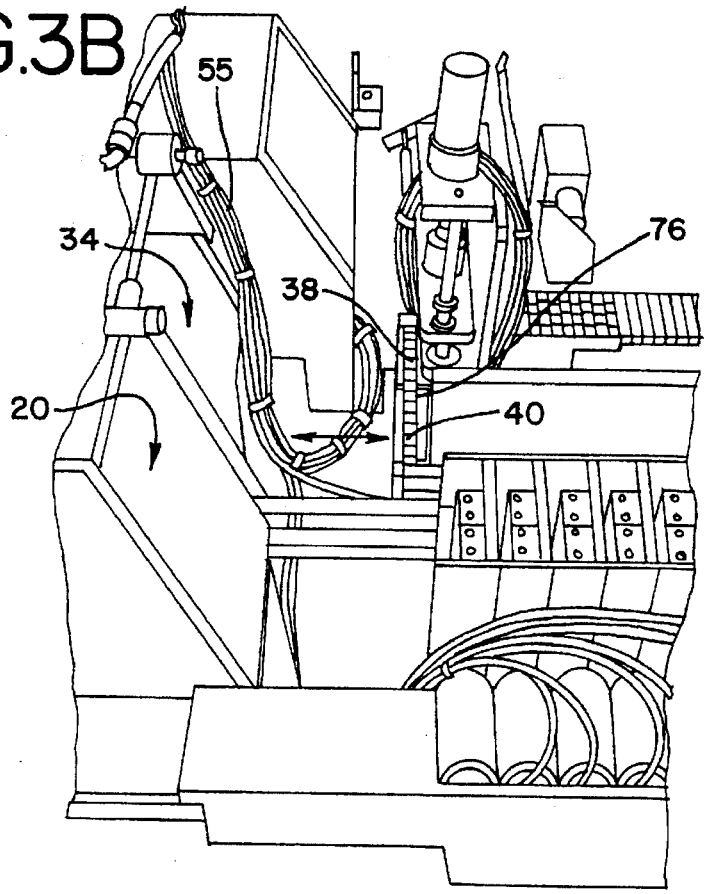
FIG. 3B is a perspective view of the harness-making machine illustrating the second connector element feed assembly and second connector termination carrier.
Figure 5:
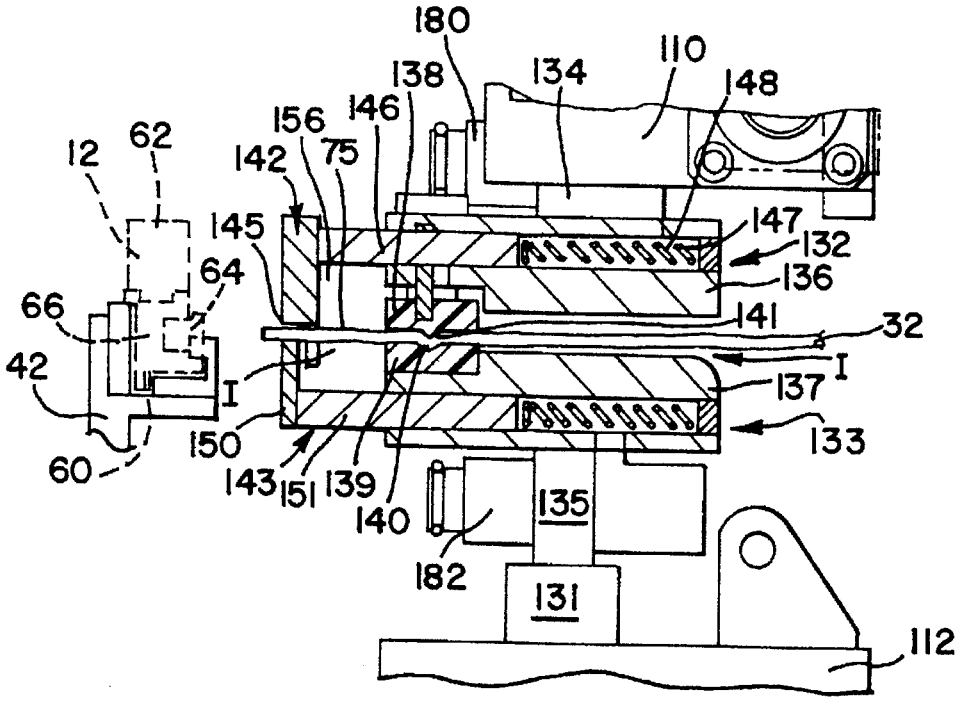
FIG. 5 is a sectional view of a clamping head assembly used in the wire cutting and positioning apparatus of FIG. 1 shown in an initial clamping position after the harness wires have been cut to define the harness wire free ends and prior to transfer to a second work location within the harness-making machine.
Figure 6:
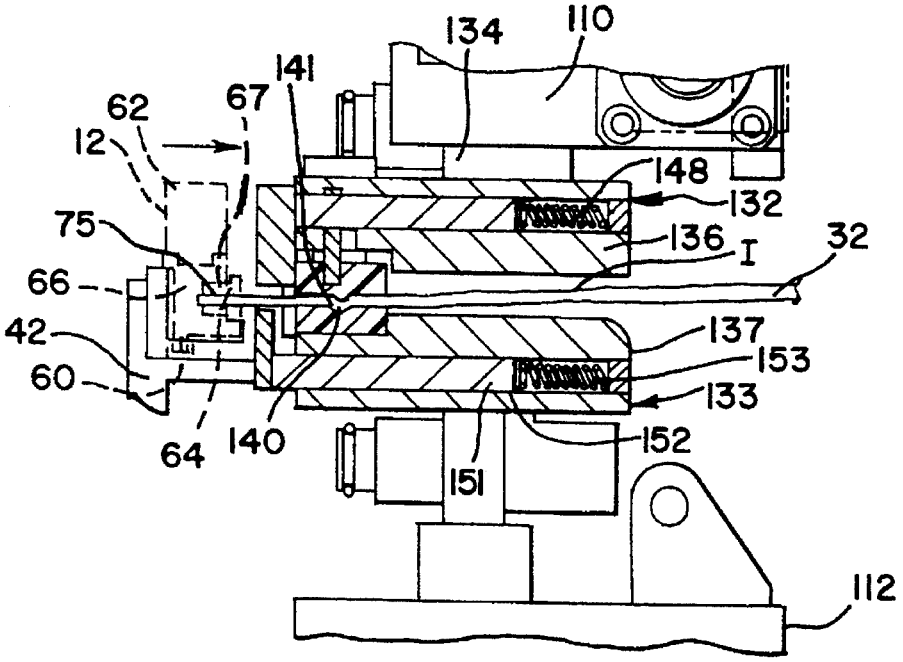
FIG. 6 is a sectional view of the clamping head assembly shown in FIG. 5, after it has moved to the second work location within the wire-harness-making machine illustrating the wire free ends exposed for termination to second connector elements.

The transfer assembly 100 includes a wire clamping mechanism 130 (FIGS. 1, 2) in the form of a clamping head having opposing clamping members 132,133 which are slidably mounted on respective vertical guide posts 134, 135 of each transfer carriage 110, 112 through the use of pneumatic cylinders 131. The two opposing clamping members 132,133 are best illustrated in FIGS. 3A, 5 & 6. Each of the clamping members 132, 133 includes respective base portions 136, 137 which in turn include respective top and bottom clamping plates 138, 139 made of rubber or some other compliant material. The bottom clamping plate 139 preferably is formed with a longitudinal groove 140 which receives the bottom portions of harness wires 32 held within the transfer assembly 100. Similarly, the top clamping member base portion includes an opposing clamping plate 138 having a longitudinal protuberance 141 extending therefrom and disposed therein in general alignment with the bottom clamping plate groove 140. When the clamping members 132, 133 are brought together vertically along the guide posts 134, 135, the harness wires 32 are held in place between the opposing groove and protuberance.

Figure 4C:
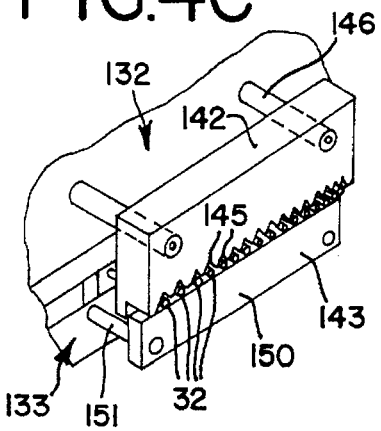
FIG. 4C is a perspective view of the wire locator and support bars of FIG. 4A.
Figure 4B:
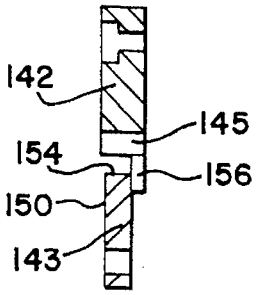
FIG. 4B is a sectional view of FIG. 4A taken along lines A—A thereof.
Figure 4A:
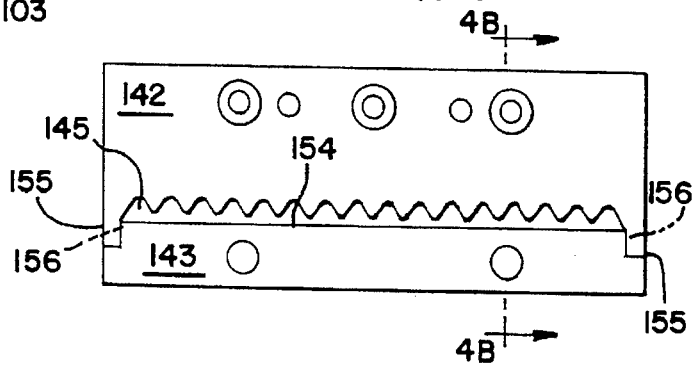
FIG. 4A is an elevational view of the wire locator and support bars of the wire transfer assembly of FIG. 1 illustrating their engagement with each other.

Importantly, the clamping head includes means for accurately positioning and gripping the harness wires 32 therein comprising a wire locator 142 and a corresponding wire support 143 (FIGS. 4A–4C). Each of said locator and support includes elongated bars that are collapsible upon their respective clamping members 132, 133 in a direction generally parallel to the axes of the harness wires 32 and generally perpendicular to the longitudinal axes of the two clamping plates 138,139. The wire locator 142 includes an elongated grooved bar having a plurality of slots, or grooves 145, formed therein along a lower surface thereof. The wire locator bar 142 is mounted upon a pair of slider rods 146 (FIGS. 5, 6) which are received within corresponding bores, or recesses 147 of the top clamping member 132 and preferably abut compression springs 148 to provide the wire locator 142 with its collapsible action as explained in greater detail below. In addition, pneumatic cylinder 180 is provided to retract and extend wire locator bar 142.

Similarly, the bottom clamping member 133 includes a collapsible wire support 143 in the form of an elongated bar 150 (FIGS. 4A, 4B), which is also supported by a pair of slider rods 151 (FIGS. 5, 6). The support bar slider rods 151 are also received in corresponding bores 152 and also abut compression springs 153 disposed therein. The support bar 143 supports the harness wires at the free end portions thereof by providing a support surface 154 for the harness wires 32. As with wire locator 142, support bar 143 also has a pneumatic cylinder 182 for retracting and extending the bar as described below.

The ends 155 of the support bar 143 preferably engage the wire locator bar 142 at two recesses, or steps 156 (FIGS. 4B, 4C), formed therein at its opposite ends in a manner such that when the support bar 143 is contacted by the second carriage 42, it forces both the support bar 143 as well as locator bar 142 to collapse onto the clamping members 132, 133. After termination of the second connector element array at second termination station 34, the second carriage 42 is moved away from the transfer assembly 100. This permits springs 148, 153 to reset wire locator 142 and support bar 143 to their initial transfer positions.

Figure 9:
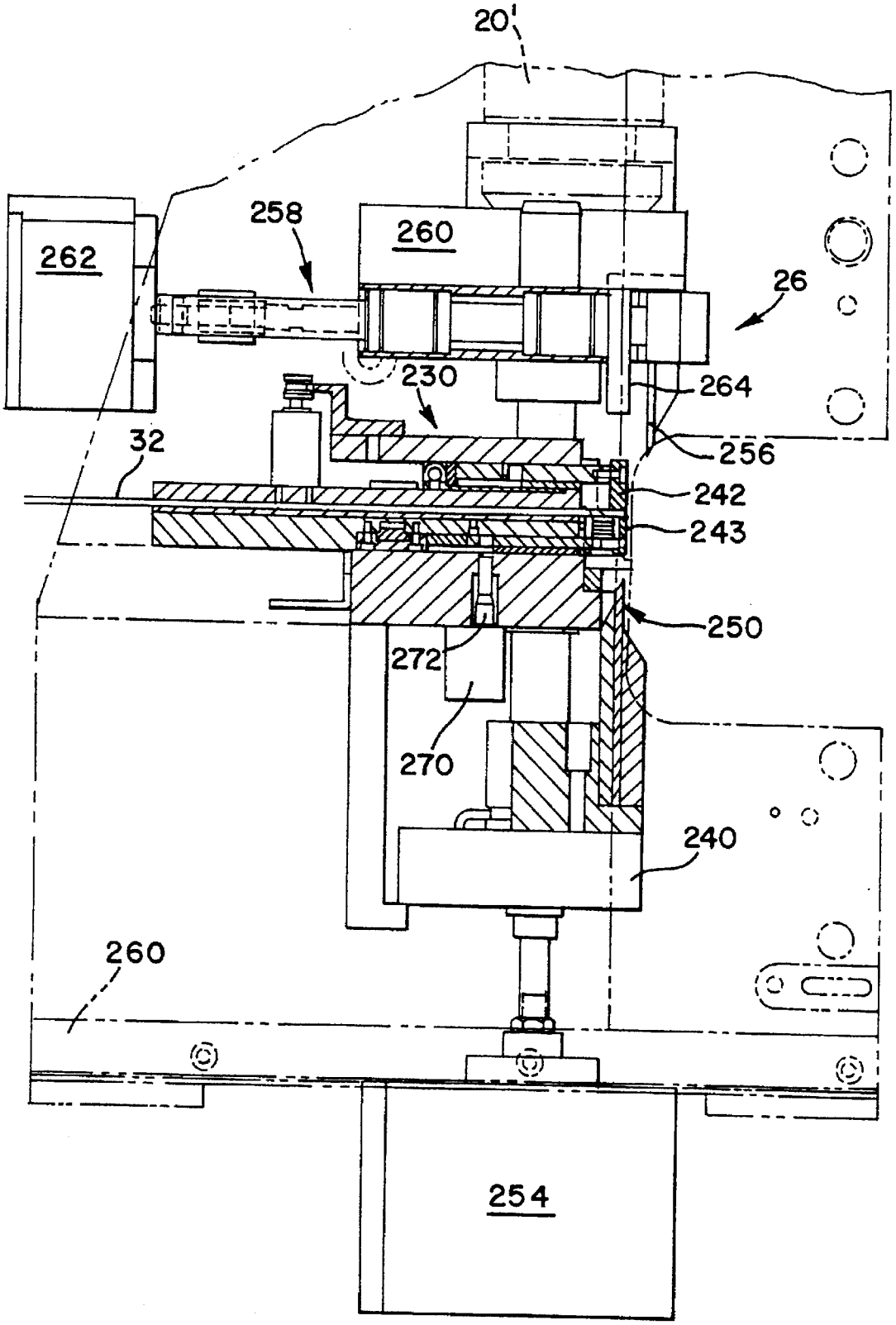
FIG. 9 is a partial sectional view of the first termination station of FIG. 8 taken generally along line 9—9.

As shown in FIG. 9, a stationary wire shifting and guiding mechanism 230 is located at the first termination station 20. Such stationary wire guiding mechanism includes slidable wire locator 242 and slidable wire support 243. Locator 242 and support 243 operate substantially identically to wire locator 142 and wire support 143 except they are contacted by the first carriage 18 and they guide the first free ends of the wires that will be terminated to the first array of connector elements 14 rather than the second free ends and the second array of connector elements 38. However, unlike the wire locator 142 and wire support 143 that are connected to pneumatic cylinders 180, 182 to cause them to extend and retract, the locator 242 and support 243 cannot be automatically retracted. Instead, after the first carriage 18 contacts support 243 and forces both locator 242 and support 243 towards frame members of the wire shifting mechanism 230, a pneumatic cylinder 270 is actuated to force a pin 272 upwards into a recess to prevent locator 242 and support 243 from springing back once first carriage 18 moves towards its "home" position in line with first transfer track 16.

The first termination station 20 also includes a mechanism 26 for cutting the wires 32. This mechanism has a lower wire cutting blade 250 that is mounted on block 252. The block and lower blade are vertically movable through the activation of pneumatic cylinder 254. An upper wire cutting blade 256 is part of a horizontally slidable assembly 258 that is mounted on first termination ram mounting base 260. Such horizontally slidable assembly is driven by a pneumatic cylinder 262 to move the upper cutting blade 256 in and out of alignment with the proper cutting location. This slidable assembly horizontally slides within first termination ram mounting base 260 which engages and is driven by a press ram in the form of a pneumatic cylinder 20'. The first termination ram 264 is also mounted on the first termination ram mounting base 260. Upon positioning upper wire cutting blade 256 in its proper position, wires 32 may be cut by actuating first press ram 20' and cylinder 254 which causes the upper and lower blades to advance towards each other until the wires are cut.

During termination of the first harness of a set of harnesses to be terminated, a series of harness wires 32 are advanced through the wire guide mechanism 22 and into wire shifting and guiding member 230 (FIG. 9) and cut to their proper lengths. The first termination carrier 18 is then brought into contact with the wire support 243 to force it and wire locator 242 against the clamping members 232, 233. Cylinder 270 is actuated to force pin 272 upward in order to retain wire locator 242 and wire support 243 in their retracted positions. The upper wire cutting blade is positioned as shown in FIG. 9 and press ram 20' is actuated to urge wires 32 into contact with the terminals of the first array 14 of connector elements to form a partial wire harness assembly 72.

The terminated first connector element array 14 is then returned back to the connector element supply track 16 when the first termination carrier 20 reciprocates back along its guide rail 28 (FIG. 7D). Wires 32 are then fed to a predetermined length to define the final length of the wire harnesses. In addition, transfer assembly 100 is moved from a position aligned with the second work station 34 to a position aligned with first work station 20. As such, the wires 32 pass through the intervening passage defined between the two opposing clamping members 132, 133 of clamping mechanism 130 when they are in their initial, spaced apart, non-clamping position. The wires also pass through the wire shifting and guiding mechanism 230.

After the wires have been fed to the desired lengths, the pneumatic cylinders 131 of each of the clamping members are actuated to clamp the wires in place. The upper wire cutting blade 256 is then moved horizontally to its position directly above lower blade 250. The pneumatic cylinders connected to wire locator 142 and wire support 143 are actuated in order to retract the locator and support from the cutting plane along which the upper and lower cutting blades will move. The first press ram 20' and pneumatic cylinder 262 are then actuated to cause the cutting blades to move towards each other to cut the wires to define a second series of free, or loose, wire ends 75 (FIG. 5) which will eventually engage the array 38 of second connector elements and a new first series of free wire ends that will subsequently be terminated to a new array of first connector elements which will start a new harness. As such, the second free ends are retained between wire clamping members 132, 133 of transfer assembly 100 while the new first free ends are maintained in position by servo motors 33, wire locator 242 and wire support 243.

The transfer assembly, with the second wire ends gripped therein, is then shifted from its alignment with the first work station 20 to alignment with the second work station 34. This shifting movement occurs simultaneously with the previously terminated array of first connector elements 14 being laterally transferred along transfer track 16 through the use of a transfer beam, which is known in the art. Pneumatic cylinders 131 operatively connected to wire locator 142 and wire support 143 are then extended to permit the wire locators and supports to return to their extended positions. Pneumatic cylinder 270 is retracted to permit wire locator 242 and wire support 243 of the first termination station to spring back to their extended positions. At such extended positions, the tips of the wires extend to the edges of the wire locators and wire supports to ensure the proper location of the wire tips.

The first transfer carriage 18, having a new array of first connector elements therein, is then moved towards the first work station 20 until the transfer carriage 18 contacts wire support bar 243 and laterally moves wire locator 242 and support bar 243 to their retracted positions at which point the first free ends of the wires have entered wire receiving apertures in the connector elements. As set forth above, cylinder 270 is actuated to retain the locator 242 and support 243 in their proper position for the next cutting cycle. Substantially simultaneously, an array 38 of second connector elements is moved into position within a second connector element supply track 76 and thereupon advanced into a second termination transfer carriage 42, which is moved towards the clamping mechanism 130 of the transfer assembly 100. The second transfer carriage 42 contacts the wire support bar 143 and laterally moves the support bar and locator bar to expose the second free ends of the wires and permit them to enter wire receiving apertures in the second array of connector elements. The slots 145 of the wire locator bars 142, 242 maintain the wires in their prearranged order and spacing throughout transfer of the harness wires 32 and termination of the free ends of the wires. Both press rams 20' and 34' are then substantially simultaneously activated to force the connector halves together in order to terminate the connector elements to the wires. The process set forth above beginning with the return of the terminated first connector element array 14 and first termination carrier 18 to supply track 16 begins again and continues until the desired number of harnesses have been terminated.

It can be seen that the present invention will enhance automated production of wire harnesses in that it provides a reliable termination transfer assembly which transfers unterminated wires from a first termination to a second termination station while protecting the free ends of the harness wires from any non-intended contact as well as maintaining them in their original feed order. This protection permits an increase in the production speed of a harness-making machine and effectively removes the transfer process as a production limiting step in the overall fabrication process.

It will be appreciated that the embodiments of the present invention which have been discussed are merely illustrative of some of the applications of this invention and that numerous modifications may be made by those skilled in the art without departing from the true spirit and scope of this invention.

We claim:

1. A wire harness assembly apparatus which produces wire harnesses of the type having a plurality of wires extending longitudinally between a first connector element and a second connector element and in which the wires are driven from a wire supply source to a first work location for insertion of first ends of said wires into the first connector element to form a partial wire harness assembly which is subsequently transferred to a second work location whereat second ends of the wires are inserted into the second connector element, comprising, in combination:

first means disposed at said first work location for maintaining the first ends of said wires in a first preselected orientation adjacent said first connector element;

means for urging said first ends of said wires into engagement with conductive portions of said first connector element to establish electrical connection therebetween;

means for moving said engaged first connector element away from said first means in a direction generally parallel to axes of portions of said wires located at said first work location and for establishing preselected lengths of said wires extending from said first connector element;

means at said first work location for cutting said wires at a position spaced from said first connector element to define said second ends of said wires;

means for transferring said second ends of said wires from the first work location to the second work location without altering a second preselected orientation of said second ends, said transferring means including second means for maintaining said Second ends of said wires in said second preselected orientation, said transferring means further including clamping means for applying a clamping force to said second ends of said wires to hold said second ends during transfer of same from said first work location to said second work location, said clamping means including two opposing clamping members, said clamping members being vertically moveable within said transferring means, each of said clamping members including a wire protection member extending outwardly therefrom, one of said wire protection members including a wire support bar having an elongated wire support surface thereon for supporting bottom portions of said wires and the other of said wire protection members including an elongated wire guide bar having a plurality of grooves formed therein along a surface which opposes said wire support surface of said wire support bar, said wire guide bar being spaced apart from said wire support bar to define a plurality of wire-receiving openings therein which receive Said wires therein in said preselected orientation and which partially enclose said second ends of said wires during transfer of said second ends of said wires from said first work location to said second work location; and, means for urging said second ends of said wires into engagement with conductive portions of said second connector element to establish electrical connection therebetween.

2. The wire harness assembly apparatus of claim 1, wherein each said wire protection member is reciprocatable between a first position spaced from its respective clamping member and a second position generally adjacent its respective clamping member, said apparatus further comprising a connector receiving nest movable between a connector supply and said first work location, said connector receiving nest receiving a first connector element therein and retaining said first connector element therein while said first ends are urged into engagement with said conductive portions of said first connector element, said connector receiving nest being operable to engage one of said wire protection members to move said wire protection member to its second position.

3. The wire harness assembly apparatus of claim 1, wherein each said wire protection member is spring loaded to provide a force to bias said member towards its second position and said apparatus further comprises at least one pneumatic cylinder for moving one of said wire protection members between said first and second position.

4. The wire harness assembly apparatus of claim 1, wherein said transferring means linearly reciprocates between said first and second work locations.

5. The wire harness assembly apparatus of claim 1, wherein said moving means moves said engaged first connector element away from said first work location.

6. A wire harness assembly apparatus which produces wire harnesses of the type having a plurality of wires extending longitudinally between a first connector element and a second connector element and in which the wires are driven from a wire supply source to a first work location for insertion of first ends of said wires into the first connector element to form a partial wire harness assembly which is subsequently transferred to a second work location whereat second ends of the wires are inserted into the second connector element, comprising, in combination:

first maintaining means disposed at said first work location for maintaining the first ends of said wires in a first preselected orientation adjacent said first connector element;

means for urging said first ends of said wires into engagement with conductive portions of said first connector element to establish electrical connection therebetween;

means for moving said engaged first connector element away from said first maintaining means in a direction generally parallel to axes of portions of said wires located at said first work station and for establishing preselected lengths of said wires extending from said first connector element;

means at said first work location for cutting said wires at a position spaced from said first connector element to define said second ends of said wires;

means for transferring said second ends of said wires from the first work location to the second work location without altering a second preselected orientation of said second ends, said transferring means including second maintaining means for maintaining said second ends of said wires in said second preselected orientation, said second maintaining means including two opposing wire clamping members, one of said two clamping members including wire guiding means mounted thereon for guiding said second ends of said wires in said second preselected orientation during transfer of said second ends of said wires to said second work location, said wire guiding means including a grooved bar, the wire guiding means extending longitudinally outwardly from said one clamping member and in alignment with longitudinal axes of said second ends of said wires, such that said second ends of said wires are received within corresponding grooves of said grooved bar, said wire guiding means further being movable towards said one clamping member upon application of an external force to said wire guiding means, whereby as said wire guiding means moves towards said one clamping member, said second ends of said wires are exposed for further processing; and, means for urging said second ends of said wires into engagement with conductive portions of said second connector element to establish electrical connection therebetween.

7. The wire harness assembly apparatus of claim 6, wherein the other of said two wire clamping members includes wire support means mounted thereon for supporting said second ends of said wires in said second preselected orientation during transfer of said second ends from said first work location to said second location, said wire support means including an elongated support surface disposed transverse to said wires and generally aligned with said wire guiding means, said wire support means being movable towards said other clamping member and further being engaged by said wire guiding means such that movement of said wire guiding means towards said one clamping member induces movement of said support bar towards said other clamping member.

8. The wire harness assembly apparatus of claim 6, further comprising a connector receiving nest movable between a connector supply and said first work location, said connector receiving nest receiving a first connector element therein and retaining said first connector element therein while said first ends are urged into engagement with said conductive portions of said first connector element, said connector receiving nest being operable to engage said wire guiding means to move said wire guiding means towards said one clamping member.

9. The wire harness assembly apparatus of claim 6, wherein said wire guiding means is spring loaded to provide a force to bias said wire guiding means away from said one clamping member and said apparatus further comprises at least one pneumatic cylinder for moving said wire guiding means relative to said one clamping member.

10. The wire harness assembly apparatus of claim 6, wherein said transferring means linearly reciprocates between said first and second work locations.

11. The wire harness assembly apparatus of claim 6, wherein said moving means moves said engaged first connector element away from said first work location.

12. A wire harness assembly apparatus which produces wire harnesses of the type having a plurality of wires extending longitudinally between a first connector element and a second connector element and in which the wires are driven from a wire supply source to a first work location for insertion of first ends of said wires into the first connector element to form a partial wire harness assembly which is subsequently transferred to a second work location whereat second ends of the wires are inserted into the second connector element, comprising, in combination:

first maintaining means disposed at said first work location for maintaining the first ends of said wires in a first preselected orientation adjacent said first connector element;

means for urging said first ends of said wires into engagement with conductive portions of said first connector element to establish electrical connection therebetween;

means for moving said engaged first connector element away from said first maintaining means in a direction generally parallel to axes of portions of said wires located at said first work station and for establishing preselected lengths of said wires extending from said first connector element;

means at said first work location for cutting said wires at a position spaced from said first connector element to define said second ends of said wires;

means for transferring said second ends of said wires from the first work location to the second work location without altering a second preselected orientation of said second ends, said transferring means including second maintaining means for maintaining said second ends of said wires in said second preselected orientation, said second maintaining means including a clamping head assembly having upper and lower opposing clamping members supported on vertical guide posts and being vertically moveable upon said guide posts, said upper clamping member including a wire locator bar movably mounted thereon having a plurality of wire-receiving channels disposed therein, the wire locator bar being selectively actuatable between first and second positions upon application of an external force thereto, each of said channels being aligned with and receiving a second end of one of said wires therein when said wire locator bar is in said first position, and each of said second ends of said wires being exposed from said channels when said wire locator bar is in said second position, said wire locator bar moving longitudinally along a length of said wires between said first and second positions; and, means for urging said second ends of said wires into engagement with conductive portions of said second connector element to establish electrical connection therebetween.

13. The wire harness assembly apparatus of claim 12, further including a support bar extending from said lower clamping member and aligned with said channels of said wire locator bar, said support bar having a wire support surface extending therealong for supporting said wires as said wire locator bar moves in unison with said support bar.

14. The wire harness assembly apparatus of claim 12, further comprising a connector receiving nest movable between a connector supply and said first work location, said connector receiving nest receiving a first connector element therein and retaining said first connector element therein while said first ends are urged into engagement with said conductive portions of said first connector element, said connector receiving nest being operable to engage said wire locator bar to move said wire locator bar to said second position.

15. The wire harness assembly apparatus of claim 12, wherein said wire locator bar is spring loaded to provide a force to bias said wire locator bar away from said upper clamping member and said apparatus further comprises at least one pneumatic cylinder for moving said wire locator bar relative to said upper clamping member.

16. The wire harness assembly apparatus of claim 12, wherein said transferring means linearly reciprocates between said first and second work locations.

17. The wire harness assembly apparatus of claim 12, wherein said moving means moves said engaged first connector element away from said first work location.

* * * * *